US009178292B2

(12) United States Patent
Stecewycz

(10) Patent No.: US 9,178,292 B2
(45) Date of Patent: Nov. 3, 2015

(54) COMPACT BATTERY CLAMP AND BOOSTER CABLE

(71) Applicant: Joseph Stecewycz, Groton, MA (US)

(72) Inventor: Joseph Stecewycz, Groton, MA (US)

( * ) Notice: Subject to any disclaimer, the term of this patent is extended or adjusted under 35 U.S.C. 154(b) by 0 days.

(21) Appl. No.: 14/085,784

(22) Filed: Nov. 20, 2013

(65) Prior Publication Data

US 2014/0220815 A1 Aug. 7, 2014

Related U.S. Application Data

(60) Provisional application No. 61/728,738, filed on Nov. 20, 2012.

(51) Int. Cl.
*H01R 11/11* (2006.01)
*H01R 4/48* (2006.01)
*H01R 4/50* (2006.01)

(52) U.S. Cl.
CPC ..... *H01R 11/11* (2013.01); *H01R 4/489* (2013.01); *H01R 4/5008* (2013.01); *Y10T 29/49174* (2015.01)

(58) Field of Classification Search
CPC .... H01R 11/24; H01R 11/281; H01R 11/288; H01R 11/289; H01R 11/11; H01R 43/00; H01R 4/489; H01R 4/5008; G01R 31/3696; H02J 7/0054; Y10T 29/49174
USPC ..... 174/146; 439/504
See application file for complete search history.

(56) References Cited

U.S. PATENT DOCUMENTS

| | | | | |
|---|---|---|---|---|
| 2,000,665 | A * | 5/1935 | Neal | 439/440 |
| 3,956,576 | A * | 5/1976 | Jensen et al. | 174/138 F |
| 4,012,582 | A * | 3/1977 | Hawkins | 174/42 |
| 4,607,904 | A * | 8/1986 | D'Alessandro et al. | 439/476.1 |
| 5,462,453 | A * | 10/1995 | Muller | 439/510 |
| 5,662,497 | A * | 9/1997 | Reilly | 439/627 |
| 5,977,485 | A * | 11/1999 | Yoshimura et al. | 174/138 F |
| 6,448,503 | B1 * | 9/2002 | McKinnon et al. | 174/146 |
| 6,695,652 | B1 * | 2/2004 | Reardon, Jr. | 439/759 |
| 2008/0173462 | A1 * | 7/2008 | Whapham et al. | 174/42 |
| 2013/0206455 | A1 * | 8/2013 | Chan | 174/154 |

* cited by examiner

*Primary Examiner* — Michael Zarroli
(74) *Attorney, Agent, or Firm* — Joseph Stecewycz

(57) ABSTRACT

Disclosed is a compact battery clamp suitable for attachment to a high-amperage, two-conductor, insulated electrical cable, the compact battery clamp comprising: a clamp handle having a first clamp handle end and a second clamp handle end; a contact arm having a first contact arm end and a second contact arm end; a pivot pin passing through the clamp handle and through the first contact arm end so as to hingedly connect the contact arm to the clamp handle; a first terminal contact pad rotatably attached to the first clamp handle end; a second terminal contact pad rotatably attached to the second contact arm end; and an electrical socket attached to the second clamp handle end, the electrical socket configured for electrically coupling with an end of the insulated electrical cable.

17 Claims, 8 Drawing Sheets

COMPACT BATTERY CLAMP AND BOOSTER CABLE

CROSS REFERENCE TO RELATED APPLICATION

The present application is related to Provisional Patent Application entitled "Compact Battery Clamp," filed 20 Nov. 2012 and assigned filing No. 61/728,738, incorporated herein by reference in its entirety.

FIELD OF THE INVENTION

This invention relates to a device for providing a method of electrically connecting to the terminals of a battery and, in particular, a device for enabling quick and convenient electrical connection to the terminals of a lead-acid battery.

BACKGROUND OF THE INVENTION

Battery cables, or booster cables, such as used in "jump starting" a vehicle, have been known in the art for some years. A set of booster cables typically includes a six-foot length of a two insulated electrical conductors of sufficient gauge to safely conduct starting current amperage. Four booster clamps, or battery clamps, resembling clothes pins and referred to as "crocodile clips," are provided at respective ends of the booster cable electrical conductor pair so as to electrically couple either two batteries, or one battery and a battery charger.

A conventional booster cable configures the battery clamps with serrated jaw ends to make mechanical and electrical contact with: (i) battery terminals or posts, if the battery is not installed in a vehicle, or (ii) vehicle battery cable terminals, if the battery is installed in a vehicle with the vehicle battery cable terminals secured onto the battery posts or terminals. The battery clamps are spring-loaded to force the clamp jaw serrations against the battery post or against the vehicle battery cable terminals, so as to provide a positive electrical connection to the respective battery post or to the vehicle battery cable terminal.

However, conventional battery clamps suffer from the shortcoming that the serrated ends of the battery clamps, typically made from copper or a copper alloy, cause indentations and other surface damage to the battery posts or vehicle cable terminals, which are typically made from lead—a softer metal than copper. Over time, the appearance and effectiveness of the battery posts or the vehicle cable terminals may suffer from repeated attachment of the booster cable.

Another shortcoming is that one of the battery clamps may be accidentally dropped into the vehicle chassis or engine compartment when a user is in the process of connecting or disconnecting the booster cable from a battery. If the vehicle is a negative-ground system, and it is the negative battery clamp that is dropped, a short circuit may result by conducting electrical current from the positive battery terminal into the chassis or engine components, and back into the battery, producing electrical arcing or sparking, and possibly igniting hydrogen gas being expelled from the charging battery.

A further shortcoming is that the connection of the booster cable to the battery typically requires using both hands to hold apart the booster clamps when securing the booster cable to the battery so as to not short out a battery connected to the other end of the booster cable. What is needed is a battery clamp configuration that overcomes the limitations of the prior art by providing a method to secure a booster cable to a battery without causing surface damage to lead-based components, while providing a good electrical contact, and which requires only one hand to attach or to remove the booster cable from a battery.

BRIEF SUMMARY OF THE INVENTION

In one aspect of the present invention, a compact battery clamp suitable for attachment to a high-amperage, two-conductor, insulated electrical cable, the compact battery clamp comprising: a clamp handle having a first clamp handle end and a second clamp handle end; a contact arm having a first contact arm end and a second contact arm end; a pivot pin passing through the clamp handle and through the first contact arm end so as to hingedly connect the contact arm to the clamp handle; a first terminal contact pad rotatably attached to the first clamp handle end; a second terminal contact pad rotatably attached to the second contact arm end; and an electrical socket attached to the second clamp handle end, the electrical socket configured for electrically coupling with an end of the insulated electrical cable.

In another aspect of the present invention, a booster cable suitable for use in charging a first battery with a second battery comprises: a two-conductor, insulated electrical cable; a first battery clamp electrically attached to a first end of the two-conductor, insulated electrical cable, the first battery clamp including a first contact arm hingedly connected to a first clamp handle, the first battery clamp generally configured in a lambda shape; and a second battery clamp electrically attached to a second end of the two-conductor, insulated electrical cable, the second battery clamp including a second contact arm hingedly connected to a second clamp handle, the second battery clamp generally configured in a lambda shape.

In still another aspect of the present invention, a method for electrically attaching a two-conductor electrical cable to battery posts, the method comprising the steps of: providing a first terminal contact pad; providing a second terminal contact pad; forcing the first terminal contact pad against a first battery terminal, and forcing the second terminal contact pad against a second battery terminal.

The additional features and advantage of the disclosed invention is set forth in the detailed description which follows, and will be apparent to those skilled in the art from the description or recognized by practicing the invention as described, together with the claims and appended drawings.

BRIEF DESCRIPTION OF THE DRAWINGS

The uses and advantages of the present invention will be more fully appreciated as the same becomes better understood from the following detailed description of the present invention when viewed in conjunction with the accompanying figures, in which.

DETAILED DESCRIPTION OF THE INVENTION

Figure 1:
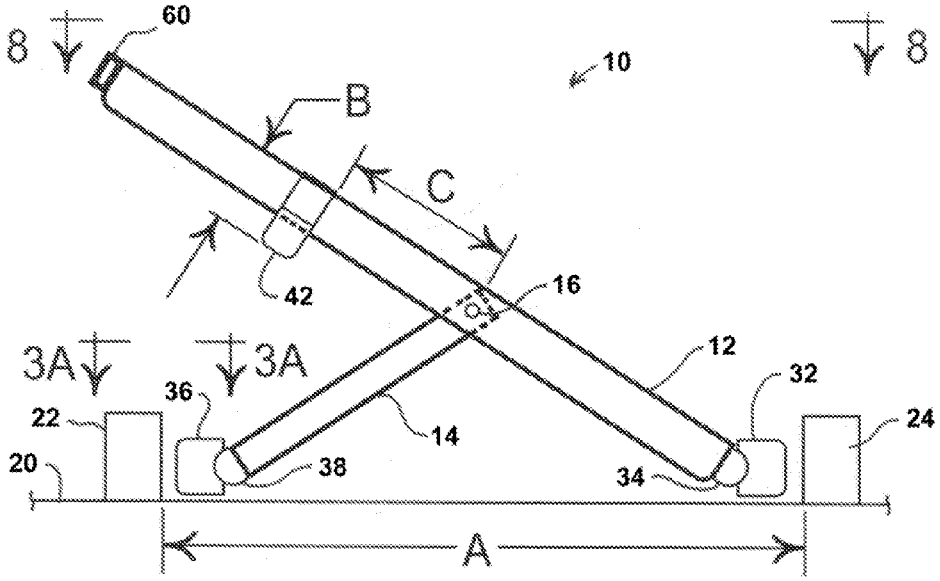
FIG. 1 is a diagrammatical illustration of a compact battery clamp in an open emplacement configuration, in accordance with an aspect of the present invention.

There is shown in FIG. 1 a side view of a compact battery clamp 10, in accordance with an aspect of the present invention. The compact battery clamp 10 comprises a clamp handle 12 with a contact arm 14, hingedly secured to the clamp handle 12 by a pivot pin 16 in a first end of the contact arm 14, the pivot pin 16 passing through both the clamp handle 12 and the contact arm 14. In the configuration shown, first end of the contact arm 14 is connected at or near the mid-point of the clamp handle 12, being thus enabled to swing through an arc of up to 180 degrees, limited only be contact with the clamp handle 12. The clamp handle 12 may comprise primarily an electrically non-conducting or insulating material, such as a high-impact plastic or a composite material, with internally-disposed electrical conductors as shown below in FIG. 9. As shown in the cross-sectional view of FIG. 10, below, the clamp handle 12 comprises a U-shaped channel, to provide strength and rigidity, while allowing rotational movement of the contact arm 14 within the open region inside the clamp handle 12.

Figure 2:
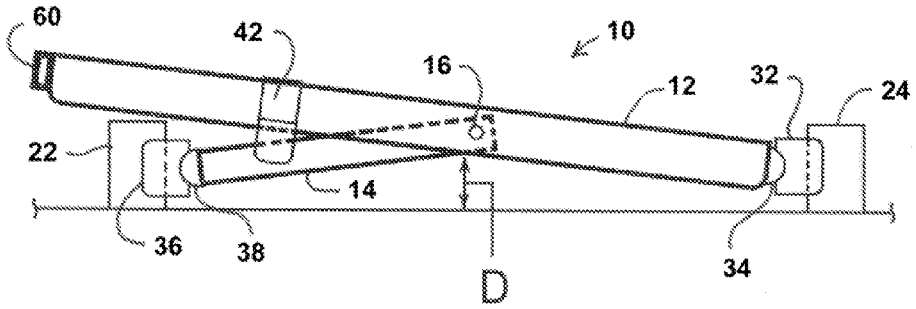
FIG. 2 is a diagrammatical illustration showing the compact battery clamp of FIG. 1, with a clamp handle and a control arm, in a closed, functioning configuration.

When in use, a user may grasp the upper portion of the clamp handle 12, and position the compact battery clamp 10 between the terminals 22 and 24 of a battery 20, substantially as shown. The compact battery clamp 10 is configured so as to maintain electrical contact with both the terminals 22 and 24 after the clamp handle 12 has been moved downwardly, towards the battery 20, as shown in FIG. 2. When in the configuration of FIG. 2, the compact battery clamp 10 functions as, and is a replacement for, a pair of conventional battery terminal clamps, or crocodile clips, as may be found in a typical set of a battery booster cable.

The clamp handle 12 may include a first terminal contact pad 32 rotatably attached to a first end of the clamp handle 12 by means of a first swivel connector 34. The first swivel connector 34 provides the terminal contact pad 32 with at least two degrees of freedom with respect to the clamp handle 12, so that the terminal contact pad 32 can be optimally swiveled and positioned against the battery terminal 24 to maximize the extent of a physical contact area. It should be understood that the contact pad may optimally position against the battery terminal 24 without requiring any adjustment from the user.

The contact arm 14 similarly includes a second terminal contact pad 36 rotatably attached to a second end of the contact arm 14 by means of a second swivel connector 38. In an exemplary embodiment, the swivel connectors 34 and 38 may each comprise a ball and socket connector pair, as known in the relevant art. This swiveling feature optimizes the area of electrical contact of the compact battery clamp 10 with the battery terminals 22 and 24, and results in a minimal voltage drop across the respective contact interfaces. It should be understood that the particular terminal contact pads 32 and 34 shown are merely exemplary of electrical connection devices that may be used at the first end of the clamp handle 12 and at the end of the contact arm 14, and that any suitable electrical contact component may be used to perform the same functions as the terminal contact pads 32 and 34.

Accordingly, when in an "open" position, shown in FIG. 1, the compact battery clamp 10 can be placed into and positioned within the open space between the terminals 22 and 24, here identified as the linear space denoted by the dimension "A." When in the open position, the clamp handle 12 and the contact arm 14 define a shape similar to the Greek letter "lambda," where the contact arm 14 corresponds to the shorter "leg" of the lambda shape.

When in a "closed" position, shown in FIG. 2, the lambda shape of the compact battery clamp 10 may be reduced in height by moving apart the terminal contact pads 32 and 36. This action serves to move the terminal contact pad 32 toward the battery terminal 24, and the terminal contact pad 36 toward the battery terminal 22. Thus, in the extended configuration shown in FIG. 2, the terminal contact pad 36 has been forced against the battery terminal 22 and the terminal contact pad 32 has been forced against the battery terminal 24.

In an exemplary embodiment, the compact battery clamp 10 can be configured so that an open space is defined between the battery 20 and the underside of the compact battery clamp 10, here indicated as dimension "D." The empty space may be desired to provide clearance for a battery retaining strap, a bracket, or a battery vent cover disposed on the surface of the battery 20 after the compact battery clamp 10 has been placed into the extended configuration.

In an exemplary embodiment, the clamp handle 12 can be releasably secured in the closed position by means of a U-spring clamp 42. By lowering the clamp handle 12 onto the contact arm 14, as shown in FIG. 2, the free ends of the U-spring clamp 42 engage both sides of the contact arm 14. The lengths of the cantilever arms of the U-spring clamp 42, here indicated as dimension "B," are preferably of sufficient length so as to partially enclose at least a portion of the contact arm 14 when the compact battery clamp 10 makes contact with the battery terminals 22 and 24.

Additionally, the selection of spring material used for the U-spring clamp 42 may produce a spring constant of sufficiently large value that the compressive force induced by the arms of the U-spring clamp 42 onto the sides of the contact arm 14 results in enough surface static friction to mitigate relative movement of the clamp handle 12 with respect to the contact arm 14. In an alternative embodiment, the contact arm 14 may include a pair of dimple features (not shown) sized and positioned on the outer surface if the contact arm 14 so as to more positively engage and retain the free ends of the U-spring clamp 42, as is well-known in the relevant art. In an alternative embodiment (not shown), the upper portion of the clamp handle 12 may be slightly curved away from the contact arm 14 so as to provide additional clearance between the upper portion of the clamp handle 12 and the battery 20 to more easily accommodate the hand of the user.

Figure 3A:
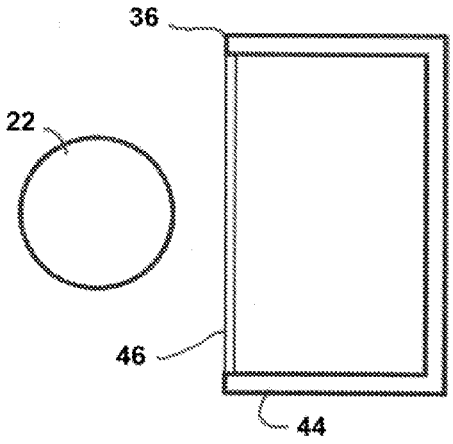
FIG. 3A is a detail view of a terminal contact pad used in the compact battery clamp of FIG. 1.
Figure 3B:
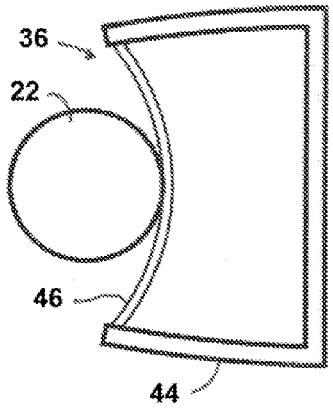
FIG. 3B is a detail view of the terminal contact pad of FIG. 3A when positioned against a battery terminal.
Figure 4:
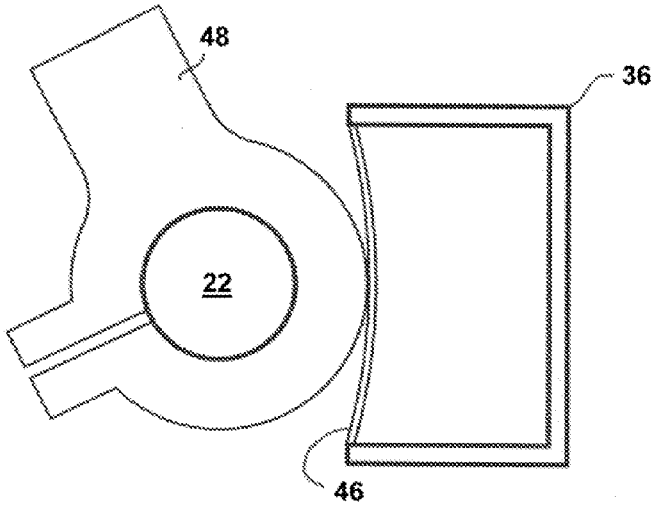
FIG. 4 is a detail view of the terminal contact pad of FIG. 3 when positioned against a battery cable clamp.

As explained above, the U-spring clamp 42 is configured to enclose and frictionally remain in position on the contact arm 14, and thus functions to restrain the clamp handle 12 from moving off the contact arm 14. The compact battery clamp 10 is, in this manner, maintained in a state of compression between the battery terminals 22 and 24 when the battery clamp 10 is emplaced for use as intended. As can be appreciated by one skilled in the art, this state of compression serves to increase the electrical conductivity at the interfaces between the battery terminals 22 and the terminal contact pads 32 and 36 of the compact battery clamp 10. In an exemplary embodiment, the U-spring clamp 42 may be re-positioned along the clamp handle 12 by a sliding motion, to change the distance from the pivot pin 16 as desired, the distance here indicated as dimension "C." In an alternative embodiment, the FIGS. 3A and 3B provide detail views of the top of the terminal contact pad 36 both before and after contact has been made with the battery terminal 22. The terminal contact pad 36 may comprise a generally U-shaped electrically-conductive contact body 44, such as a copper or aluminum alloy, and a flat flexible electrically-conductive terminal contact foil 46 attached to the legs of the terminal contact body 44, so as to form a rectangular cylinder having open ends, substantially as shown. The configuration of the terminal contact pad 32 is substantially similar to that of the terminal contact pad 36.

The thickness of the contact body 44 is preferably greater than the thickness of the terminal contact foil 46. Alternatively, the rigidity of the contact body 44 is preferably greater than the rigidity of the terminal contact foil 46. This configuration allows the terminal contact foil 46 to assume a generally curved shape, approximating the convex circumferential surface of the battery terminal 22, when forced against the battery terminal 22. This configuration also serves to return the terminal contact foil 46 to a generally planar shape when the terminal contact pad 36 is moved away from the battery terminal 22, as shown in FIG. 3B. When the terminal contact pad 36 is forced against the battery terminal 22, shown in FIG. 3B, it can be seen that the contact body 44 generally retains its shape because of the greater rigidity and wall thickness of the contact body 44.

It can thus be appreciated that the legs of the terminal contact body 44 are slightly bent inwardly when the terminal contact pad 36 is forced against the battery terminal 22, and spring back when the terminal contact pad 36 is removed from the battery terminal 22. By enabling the terminal contact foil 46 to partially wrap about the battery terminal 22, when the compact battery clamp 10 is placed into a state of tension, a greater contact area is achieved with the battery terminal 22, than if the terminal contact foil 46 remained flat, or if the terminal contact pad 36 were fabricated as a single, rigid component.

This configuration also allows for use of the compact battery clamp 10 when a vehicle battery cable clamp 48 is attached to either or both the battery terminals 22 and 24, such as may be the case when the battery 20 is mounted in a vehicle engine compartment. It can be appreciated by one skilled in the relevant art that the vehicle battery cable clamp 48 has a larger diameter than the battery terminal 22 and, because of flexibility of the terminal contact foil 46, the terminal contact foil 46 can partially wrap around both the battery cable clamp 48 and the battery terminal 22 so as to increase the area of physical and electrical contact. The compact battery clamp 10 can thus be used in the process of charging the battery 20 (*i*) when the battery 20 has been removed from a vehicle and placed on a bench, or (ii) when the battery 20 remains secured in an engine compartment and is electrically connected to a pair of vehicle battery cable clamps 48.

Figure 5:
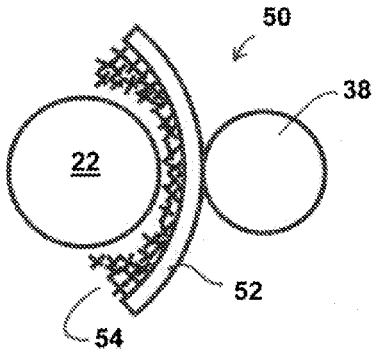
FIG. 5 is a detail view of an alternative configuration of a terminal contact pad including wire mesh, for use in the compact battery clamp of FIG. 1.

In an alternative exemplary embodiment, a terminal contact pad 50, shown in FIG. 5, may be used on the end of the end of the contact arm 14, in place of the terminal contact pad 36. Likewise, the terminal contact pad 50 may be used on the end of the clamp handle 12, in place of the terminal contact pad 32. The terminal contact pad 50 comprises one or more layers of a wire mesh 54 attached to the inside a terminal contact cup 52. The wire mesh 54 preferably comprises a corrosion-resistant metal or metal alloy, such as stainless steel.

Figure 6:
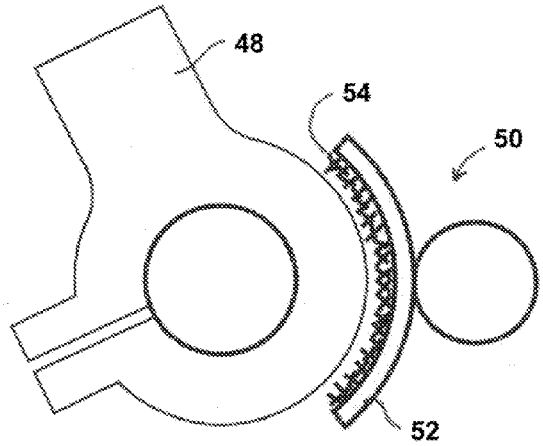
FIG. 6 is a detail view of the terminal contact pad of FIG. 5 when positioned against a battery cable clamp.

The terminal contact cup 52 is sized and shaped so as to generally conform to: (i) the outer surface contour of the battery terminal 20, as shown in FIG. 5, as well as (ii) to the outer surface contour of the battery cable clamp 48, as shown in FIG. 6. That is, the terminal contact cup 52 presents a cylindrical concave surface to the battery terminal 20. The configuration shown serves to increase the surface area of electrical contact between the terminal contact pad 50 and the battery terminal 22, for example, than if no wire mesh 54 were provided on the terminal contact cup 52.

As can be appreciated, the contact cup 52 may be too inflexible to usefully conform to the outer contour of the battery terminal 22 or to the outer contour of the battery cable clamp 48. Consequently, electrical resistance is thereby reduced between the terminal contact pad 50 and the battery terminal 22, and between the terminal contact pad 50 and the battery cable clamp 48. In addition, the terminal contact cup 52 may be mounted to the swivel connector 38 for the reasons stated above.

Figure 7:
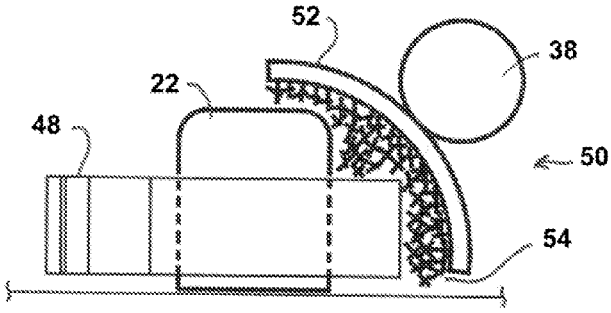
FIG. 7 is a detail view of the terminal contact pad of FIG. 5 when positioned against both a battery cable clamp and a battery terminal.

As shown in FIG. 7, the terminal contact pad 50 can be rotated ninety degrees, more or less, about the longitudinal axis of the contact arm 14 and positioned so as to physically and electrically contact both the battery cable clamp 48 and the battery terminal 22. It can be appreciated by one skilled in the art that, when the compact battery clamp 10 is placed in a compression state between the battery terminals 22 and 24, or between battery cable clamps 48, the wire mesh 54 is selectively compressed to generally conform to and substantially fill the space between the terminal contact cup 52 and the battery terminal 22, as in FIG. 5, or between the terminal contact cup 52 and the battery cable clamp 48, as in FIG. 6, or between the terminal contact cup 52 and both the battery terminal and the battery cable clamp 48, as in FIG. 7. As stated above, this compressible feature of the wire mesh 54 serves to increase the surface contact area between the respective components, and thus increases the electrical conductance between the respective components.

Figure 8:
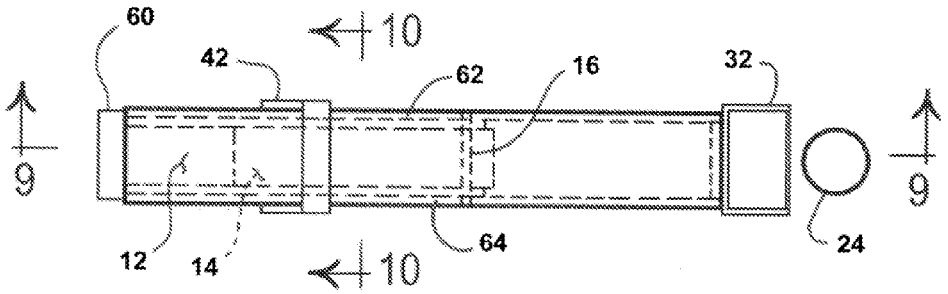
FIG. 8 is a diagrammatical top view of the compact battery clamp of FIG. 1.

FIG. 8 provides a top view of the compact battery clamp 10 of FIG. 1. As can be seen in FIG. 8 and in the cross-sectional view of FIG. 9, an electrical socket 60 is provided at a second end of the U-shaped channel clamp handle 12. In an exemplary embodiment, the electrical socket 60 comprises a first electrical connector 72 and a second electrical connector 74. The electrical socket 60 allows for a pair of insulated electrical cables 28, shown in FIG. 18 below, to be plugged into the compact battery clamp 10 for use in "jumping" a lead-acid battery, for example, as is well-known in the relevant art. Preferably, the electrical connectors 72 and 74 form a polarized set so as to permit only one connection orientation when attaching the electrical cables 28 to the compact battery clamp 10.

Figure 18:
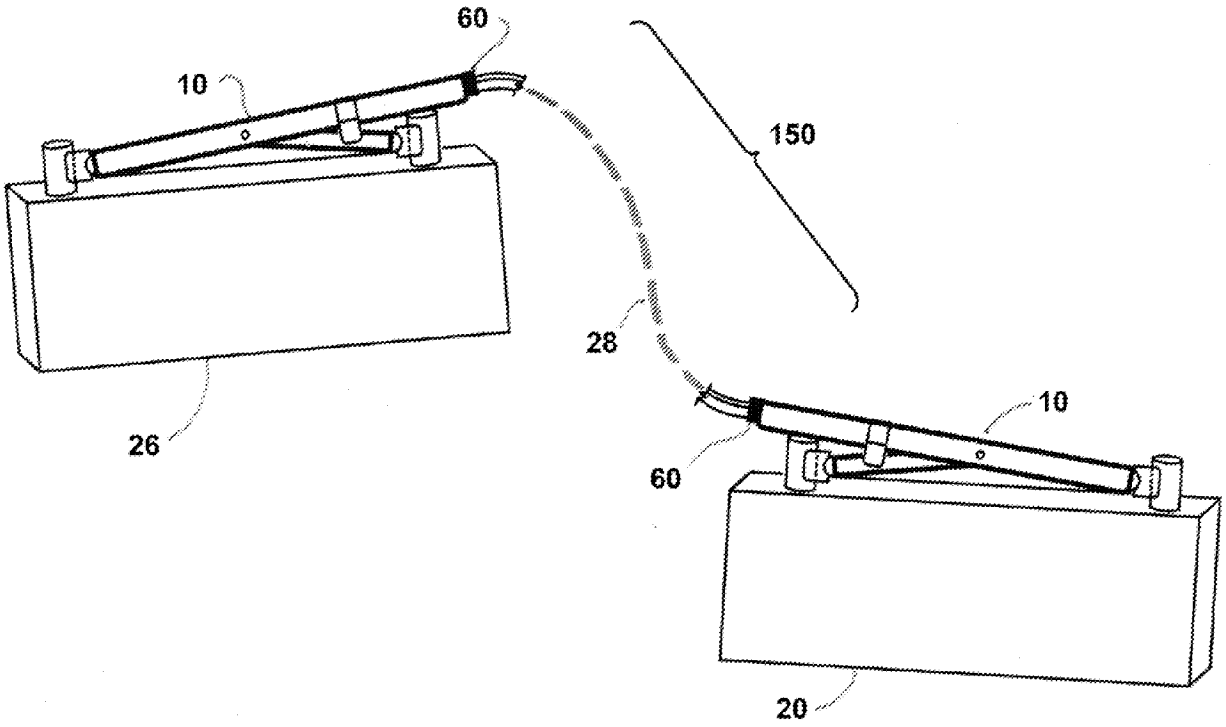
FIG. 18 is an exemplary embodiment of a booster cable comprising two compact battery clamps of FIG. 1 electrically coupled to opposite ends of a high-amperage, two-conductor, insulated electrical cable, in accordance with the present invention.

As the electrical cables 28 can be attached or removed as desired, the combination of two compact battery clamps 10 and the pair of electrical cables 28 provide for a booster cable assembly 150, shown in FIG. 18, that is more compact, and less likely to tangle, than a conventional set of battery jumper cables or booster wires that use crocodile clip battery terminal attachment means.

Figure 9:
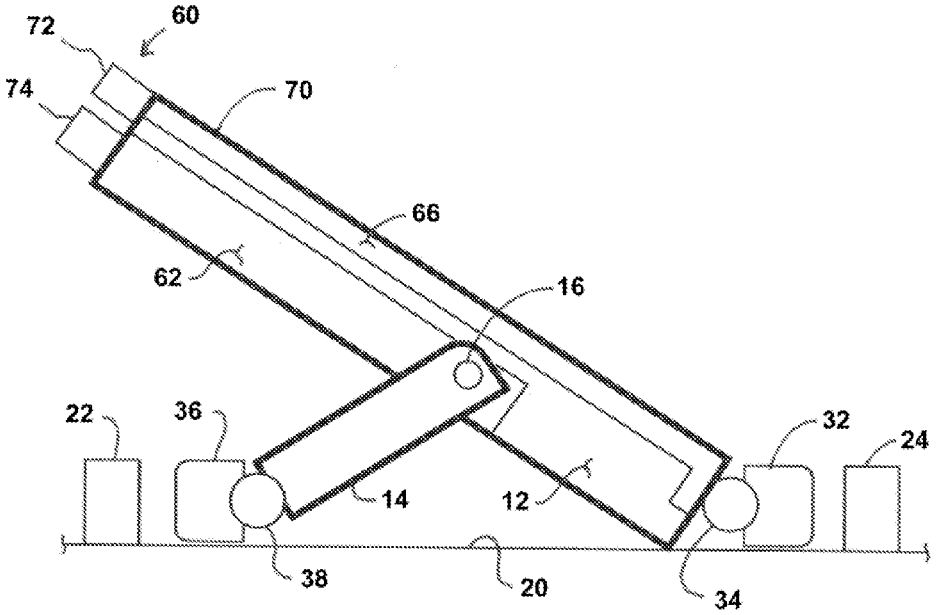
FIG. 9 is a longitudinal cross sectional view of the compact battery clamp of FIG. 8 showing first and second electrical conductors providing an electrical path between battery terminals and an electrical socket.
Figure 10:
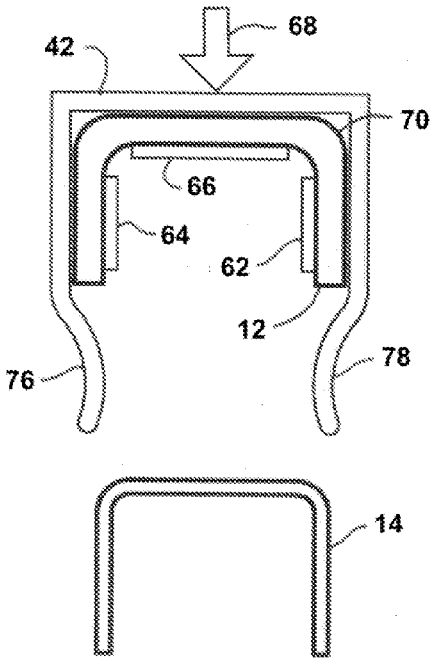
FIG. 10 is transverse cross-sectional view of the compact battery clamp of FIG. 8 showing first, second, and third electrical conductors providing an electrical path between battery terminals and the electrical socket of FIG. 9.

As best seen in FIG. 9 and in the cross-sectional view of FIG. 10, a first electrical conductor 62 is provided between the electrical connector 74 and the pivot pin 16. Similarly, as seen in FIG. 8, a second electrical conductor 64 is provided between the electrical connector 74 and the pivot pin 16. The electrical conductors 62 and 64 may each comprise a thick, but narrow, bar of electrically-conductive material, such as copper or aluminum. The electrical conductors 62 and 64 are of sufficient cross sectional area, and have sufficient conductance, so as to permit the flow of electrical current sufficient to charge the battery 20, for example.

As also seen in FIGS. 9 and 10, a third electrical conductor 66 is provided between the electrical connector 72 and the swivel connector 34. The third electrical conductor 66 may similarly comprise a thick, but narrow, bar of electrically-conductive material, such as copper or aluminum, having a sufficient cross sectional area and conductance so as to permit the return flow of electrical current for charging purposes.

It can thus be appreciated by one skilled in the art that a first electrical path runs from the electrical connector 72, through the third electrical conductor 66, through the swivel connector 34, through the terminal contact pad 32, and to the battery terminal 24. A second electrical path runs from the electrical connector 74, through both the first electrical conductor 62 and the second electrical conductor 64, through the pivot pin 16, through the contact arm 14, through the swivel connector 38, through the terminal contact pad 36, and to the battery terminal 22. In an exemplary embodiment, an insulating layer 70 may be provided on the surface of the clamp handle 12 to reduce the risk of electrical shorts during emplacement and positioning of the compact battery clamp 10 between the battery terminals 22 and 24, and near protruding metal components, such as may be found in the engine compartment of a motorized vehicle.

Figure 11:
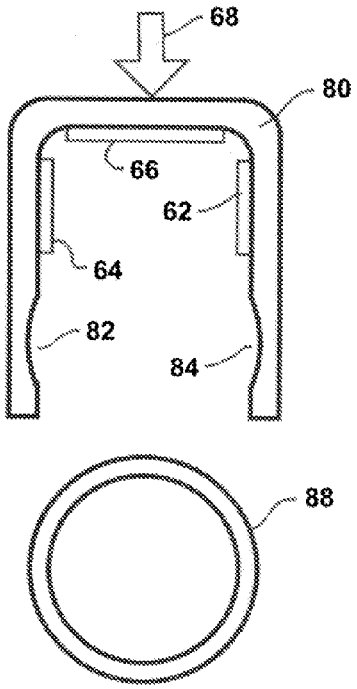
FIG. 11 is a transverse cross-sectional view of an alternative configuration of a clamp handle for use with a tubular control arm.

As also shown in the cross-sectional view of FIG. 10, the U-spring clamp 42 comprises a first flexible clamp leg 76 and a second flexible clamp leg 78. When the clamp handle 12 is pushed towards the contact arm 14, as indicated by arrow 68, the flexible clamp legs 76 and 78 bear against the sides of the contact arm 14 to prevent movement of the clamp handle 12 away from the contact arm 14, as explained above in greater detail. In an alternative exemplary embodiment, shown in FIG. 11, the channel-shaped contact arm 14 may be replaced by a tubular contact arm 88.

Accordingly, in the alternative embodiment, the combination of the clamp handle 12 and the U-spring clamp 42 may be replaced by a clamp handle 80 comprising interior concave recesses 82 and 84, as shown, for retention of the tubular contact arm 88. When the clamp handle 80 is pushed towards the tubular control arm 88, the tubular control arm 88 may enter the clamp handle 80 and engage both the recesses 82 and 84. This can function to place the corresponding clamp handle 12 into a state of compression between battery terminals or vehicle battery cable clamps, as explained in greater detail above.

Figure 12:
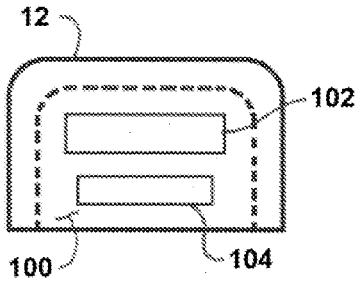
FIG. 12 is a diagrammatical illustration of an exemplary embodiment of an electrical socket having horizontal polarized socket slots.
Figure 13:
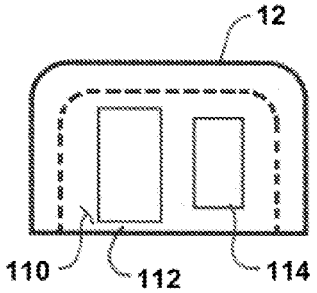
FIG. 13 is a diagrammatical illustration of another exemplary embodiment of an electrical socket having vertical polarized socket slots.

It should be understood that the configuration of the mating socket openings in the electrical socket 60 is not limited to any one particular geometric shape. As shown in FIG. 12, an electrical socket 100 may be emplaced on the end of the clamp handle 12. The electrical socket 100 includes a first slot opening 102, and a second, smaller slot opening 104, where the slot openings 102 and 104 form a polarized pair of parallel slots having longer widths than heights. Accordingly, the electrical cable 28 would include spade-like plugs (not shown for clarity of illustration) to mate with the slot openings 102 and 104. In an exemplary alternative embodiment, shown in FIG. 13, an electrical socket 110 includes a first slot opening 112, and a second, smaller slot opening 114, where the slot openings 112 and 114 form a polarized pair of parallel slots having larger heights than widths. Alternatively, the electrical socket 60 may include two slots (not shown) oriented as ninety degrees to one another rather than having a parallel orientation.

Figure 14:
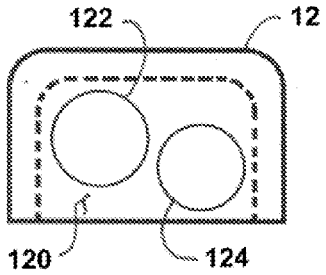
FIG. 14 is a diagrammatical illustration of still another exemplary embodiment of an electrical socket having circular socket openings.

In an exemplary alternative embodiment, shown in FIG. 14, an electrical socket 120 includes a first circular opening 122, and a second circular opening 124, where the diameter of the first circular opening 122 is different from the diameter of the second circular opening 124. Accordingly, the electrical cable 28 would include cylindrical termination plugs (not shown for clarity of illustration) to mate with the circular openings 122 and 124.

Figure 15:
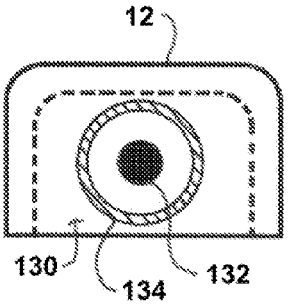
FIG. 15 is a diagrammatical of yet another exemplary embodiment of an electrical socket having a coaxial opening configuration for mating with a coaxial plug on a pair of battery cable conductors.

In yet another exemplary alternative embodiment, shown in FIG. 15, an electrical socket 130 includes a coaxial-type configuration, in which a center electrical contact pin 132 is positioned inside a generally cylindrical conductive layer 134. Accordingly, the electrical cable 28 would include a coaxial-type plug (not shown for clarity of illustration) at each end of the electrical cable, to mate with the coaxial-type socket 130. It can be appreciated that, no matter which configuration of electrical socket is used with the clamp handle 12, the electrical cable 28 will include appropriate mating plugs, where the mating plugs can be electrically connected to the electrical socket 100, to the electrical socket 110, to the electrical socket 120, or to the electrical socket 130, as is well-known in the relevant art.

Figure 16:
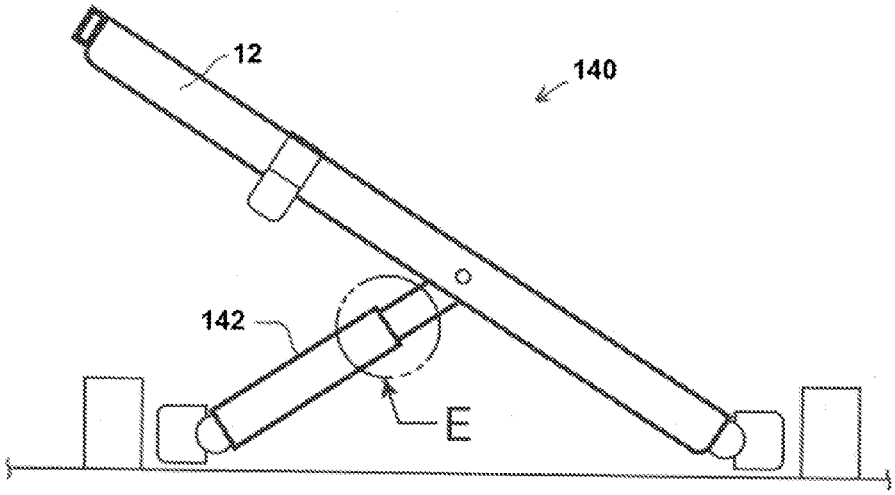
FIG. 16 is a diagrammatical illustration of an alternative embodiment of a compact battery clamp with an adjustable two-component control arm, in accordance with an aspect of the present invention.
Figure 17:
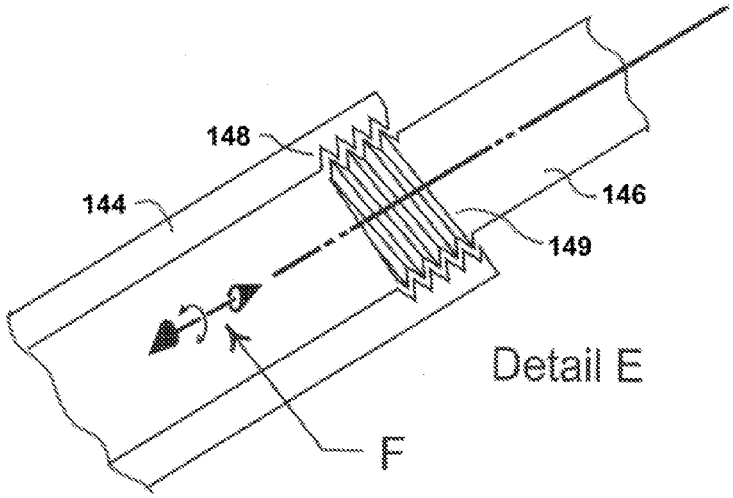
FIG. 17 is a detail illustration of the threaded connection for the two components of the control arm of FIG. 16.

In an exemplary embodiment, shown in FIG. 16 and the detail view of FIG. 17, a compact battery clamp 140 comprised the clamp handle 12 and a cylindrical contact arm 142. The length of the contact arm 142 may be adjusted by rotating a lower tubular member 144 with respect to an upper cylindrical member 146, as indicated by arrow "F." This adjustment feature allows a single compact battery clamp 140 to be used on different batteries, having different terminal-to-terminal dimensions, denoted as dimension "A" in FIG. 1, as described above.

The adjustment feature may include an internal thread 148 formed in the lower tubular member 144, and an external thread 149 formed on the upper cylindrical member 146, for example. That is, the lower tubular member 144 thus has a threaded interface with the upper cylindrical member 146. The upper cylindrical member 146 may comprise a solid rod, or a hollow tube, as may be specified by a product designer. Alternatively, a chuck-like configuration (not shown) can be included on the upper end of the lower tubular member 144, to enable a sliding adjustment of the upper cylindrical member 146 into and out of the lower tubular member 144.

There is shown in FIG. 18 an exemplary embodiment of the booster cable 150 as may be used in charging a discharged battery 26 with a charged battery 20. As described above, the innovative booster cable 150 includes the high-amperage, two-conductor, insulated electrical cable 28, or insulated cable pair, with the electrical socket 60 of a first compact battery clamp 10 electrically coupled to a first end of the electrical cable 28, and the electrical socket 60 of a second compact battery clamp 10 electrically coupled to a second end of the electrical cable 28. Preferably, there is provided a first electrical path: (i) from the first terminal contact pad 32 on the clamp handle 12 in the first compact battery clamp 10, (ii) through one of the conductors in the high-amperage, two-conductor, insulated electrical cable 28 and (iii) to the first terminal contact pad 32 on the clamp handle 12 in the second compact battery clamp 10. Similarly, there is provided a second electrical path: (i) from the second terminal contact pad 36 on the control arm 14 in the first compact battery clamp 10, (ii) through the other one of the conductors in the high-amperage, two-conductor, insulated electrical cable 28 and (iii) to the second terminal contact pad 36 on the control arm 14 in the second compact battery clamp 10.

For clarity of illustration, the booster cable 150 is shown attached to the battery posts of the batteries 20 and 26, but it should be understood that the compact battery clamps 10 may be used as well when vehicle battery cable terminals remain emplaced on the battery posts of one or both batteries 20, 26. In an alternative embodiment, one or two compact battery clamps 140 (not shown) may be used in place of one or both the compact battery clamps 10, at respective ends of the high-amperage, two-conductor, insulated electrical cable 28, in accordance with the present invention.

It is to be understood that the description herein is only exemplary of the invention, and is intended to provide an overview for the understanding of the nature and character of the disclosed booster cable and battery clamp configurations. The accompanying drawings are included to provide a further understanding of various features and embodiments of the method and devices of the invention which, together with their description and claims serve to explain the principles and operation of the invention.

What is claimed is:

1. A compact battery clamp suitable for attachment to a high-amperage, two-conductor, insulated electrical cable, said compact battery clamp comprising:

a clamp handle having a first clamp handle end and a second clamp handle end;

a contact arm having a first contact arm end and a second contact arm end;

a pivot pin passing through said clamp handle and through said first contact arm end so as to hingedly connect said contact arm to said clamp handle;

a first terminal contact pad rotatably attached to said first clamp handle end;

a second terminal contact pad rotatably attached to said second contact arm end; and an electrical socket attached to said second clamp handle end, said electrical socket configured for electrically coupling with an end of the insulated electrical cable.

2. The compact battery clamp of claim 1 wherein said pivot pin passes through a mid-point of said clamp handle.

3. The compact battery clamp of claim 1 wherein said first contact arm end is connected proximate a mid-point of said clamp handle.

4. The compact battery clamp of claim 1 further comprising a first swivel connector for attaching said first terminal contact pad to said first clamp handle end, and a second swivel connector for attaching said second terminal contact pad to said second contact arm end.

5. The compact battery clamp of claim 4 wherein said first swivel connector comprises a ball and socket connector pair.

6. The compact battery clamp of claim 1 further comprising a U-spring clamp attached to said clamp handle, said U-spring clamp positioned so as to releasably engage said contact arm.

7. The compact battery clamp of claim 1 further comprising an interior concave recess disposed inside said clamp handle, said interior concave recess positioned so as to releasably engage said contact arm.

8. The compact battery clamp of claim 1 wherein said clamp handle comprises an electrically non-conductive material.

9. The compact battery clamp of claim 1 wherein said contact arm comprises an electrically conductive material.

10. The compact battery clamp of claim 1 further comprising a first electrical conductor providing a first electrically conductive path between said electrical socket and said pivot pin and a second electrical conductor providing a second electrically conductive path between said electrical socket and said pivot pin.

11. The compact battery clamp of claim 1 further comprising a third electrical conductor providing a third electrically conductive path between said electrical socket and said first terminal contact pad.

12. The compact battery clamp of claim 1 wherein said first terminal contact pad comprises a terminal contact foil disposed on a U-shaped electrically conductive body.

13. The compact battery clamp of claim 1 wherein said first terminal contact pad comprises a wire mesh disposed within a terminal contact cup.

14. The compact battery clamp of claim 1 wherein said contact arm comprises a lower tubular member connected to an upper cylindrical member, said lower tubular member having a threaded interface with said upper cylindrical member.

15. A booster cable suitable for use in charging a first battery with a second battery, said booster cable comprising:

a two-conductor, insulated electrical cable;

a first battery clamp electrically attached to a first end of said two-conductor, insulated electrical cable, said first battery clamp including a contact arm hingedly connected to a clamp handle by a pivot pin, said first battery clamp further having a terminal contact pad connected to said contact arm; and a second battery clamp electrically attached to a second end of said two-conductor, insulated electrical cable.

16. The booster cable of claim 15 wherein said booster cable is configured to provide an electrical path, from said terminal contact pad, through a conductor in said two-conductor, insulated electrical cable, and to said second battery clamp.

17. A method of electrically attaching a two-conductor electrical cable to battery posts and terminals, said method comprising the steps of:

providing a first terminal contact pad, said first terminal contact pad connected to a clamp handle, said clamp handle having a contact arm hingedly secured to said clamp handle by a pivot pin;

providing a second terminal contact pad, said second terminal contact pad connected to said contact arm;

positioning said first terminal contact pad against a first battery terminal, and, pushing said clamp handle towards said contact arm to force said first terminal contact pad against said first battery terminal and force said second terminal contact pad against a second battery terminal.

* * * * *